US005231949A

United States Patent [19]

Hadley

[11] Patent Number: 5,231,949

[45] Date of Patent: Aug. 3, 1993

[54] DIHEDRAL TUNNEL BOAT HULL

[76] Inventor: Robert Hadley, 2111 Bitter Creek Dr., Austin, Tex. 78744

[21] Appl. No.: 988,038

[22] Filed: Dec. 9, 1992

Related U.S. Application Data

[63] Continuation of Ser. No. 771,045, Oct. 2, 1991, abandoned, which is a continuation-in-part of Ser. No. 522,374, May 8, 1990, abandoned.

[51] Int. Cl.[5] ..... B63B 1/00

[52] U.S. Cl. ..... 114/271; 114/56; 114/61

[58] Field of Search ..... 114/56, 57, 61, 283, 114/288, 291, 355-359, 271

[56] References Cited

U.S. PATENT DOCUMENTS

| | | | |
|---|---|---|---|
| 3,148,652 | 9/1964 | Canazzi | 114/56 |
| 3,303,809 | 2/1967 | Ross | 114/56 |
| 3,625,173 | 12/1971 | Mitton | 114/61 |
| 3,996,869 | 12/1976 | Hadley | 114/61 |
| 4,192,248 | 3/1980 | Moyer | 114/56 |
| 4,348,972 | 9/1982 | Parsons | 114/61 |
| 4,492,176 | 1/1985 | Arima | 114/56 |
| 4,655,157 | 4/1987 | Sapp | 114/56 |

*Primary Examiner*—Jesus D. Sotelo

*Attorney, Agent, or Firm*—Cook, Egan McFarron and Manzo, Ltd.

[57] ABSTRACT

This invention is an improved boat hull design for stable operation as a planing-type hull in a wide range of water conditions. The hull is comprised of a substantially V-shaped central hull portion and a pair of adjacent side floats, one on each side of the central hull. The inner walls of the side floats are substantially vertical, and the floats are stepped upwardly at approximately midships, such that the rear portion of the side floats is substantially horizontal, or parallel to the plane of the water surface. At least one pair of flat surfaces are formed along the bottom portion of the hull positioned at the intersection of lowermost strakes and steps formed on each side of the hull, so as to provide substantially improved stability and attitude when running at high speed on rough water. A dihedral tunnel is formed by the concavely-curved surfaces of the central hull in combination with the inner walls of the side floats. The inner walls extend rearward beyond the steps to approximately 3 feet forward of the stern or transom, becoming "traps" that contain hydrodynamic forces helping to provide lift under the hull.

5 Claims, 3 Drawing Sheets

DIHEDRAL TUNNEL BOAT HULL

This is a continuation application of U.S. application Ser. No. 07/771,045 filed Oct. 2, 1991, which is a continuation-in-part application of U.S. application Ser. No. 07/522,374, filed on May 8, 1990, both now abandoned.

BACKGROUND OF THE INVENTION

This invention relates to boat hulls generally, and more particularly to an improved planing-type hull for providing substantially improved stability and maneuverability in rough water.

Planing-type hulls are designed to move generally over the water rather than through it, as do displacement type hulls. Planing can be defined as that stage at which dynamic forces due to the motion of the hull through the water begin to make their influence felt.

May previously issued U.S. Pat. No. 3,996,869 disclosed and claimed a dihedral tunnel boat hull having side floats coextensive with a substantially V-shaped central hull. As disclosed in that patent, deep V hulls provide the softest riding hull in rough or choppy water. My earlier patented design was successful in overcoming many of the drawbacks of a deep V hull, primarily instability, through the use of a central V hull with side floats. These side floats had deeper drafts than the central hull. Once the desired speed is reached, the outer floats approach the desired planing motion. These side floats had outer hull surfaces which were stepped, while the inner surfaces were substantially vertical. A draft angle minimum of 3° is essential to withdraw a manufactured part from a mold. My earlier design was successful in providing a softer, smoother ride over rough water at speeds in excess of 30 m.p.h., as well as providing greater load carrying capabilities.

However, my earlier dihedral boat hull did not achieve the degree of maneuverability in rough water that a true planing-type hull would have in smooth water. While maintaining substantial portions of the basic design as disclosed in my previously issued U.S. Pat. No. 3,996,869, additional changes were required to achieve the degree of stability and maneuverability possible with this improved bihedral tunnel boat hull design.

SUMMARY OF THE INVENTION

This invention, which employs a dihedral tunnel concept, including a V type central hull and twin sponsons which are an integral part of the hull, also includes the addition of a flat surface on each sponson. For additional stability and maneuverability, a second pair of chines is formed from amidship rearward to the transom.

The addition of these chines, coupled with a reduction in the angle formed by the central hull, produces a substantial increase in the stability, maneuverability, and smoothness of the ride and prohibits excessive banking in turns.

As in the design shown in U.S. Pat. No. 3,996,869, the outer hull surfaces of the sponsons or floats are similar to the traditional seaplane floats halved lengthwise. The inner surfaces are substantially vertical, forming the inner side walls of the dihedral tunnel. The coupling of the dihedral tunnel concept, together with the formation of the forward and rear pairs of chines provide a substantial increase in the degree of stability and maneuverability of the boat in rough water. Greater useful lift has been attained.

The hull design described herein reduces excessive banking in turns, improves the static, dynamic, lateral and directional stabilities of a boat having this design, contributes some lift to the boat while under power, and reduces or nearly eliminates the spray or wet look when the boat is under power. The improved boat hull described herein provides improved attitude on the water, reduces the drag coefficient of the boat through the water under power, provides substantial additional load carrying capabilities as well as easy maneuverability and increased safety and comfort over a wide range of water conditions.

An additional improvement with the present invention is that the beam-to-length ratio, commonly known as the aspect ratio, is able to be increased so as to provide greater load carrying capability, as well as usable space, while maintaining or providing greater lateral and directional stability but at the same speed as boat hulls presently known in the prior art. The present design enables the user to increase the load carrying capability of any boat having the hull design disclosed in the present application while at the same time maintaining improved speed, maneuverability, and fuel efficiency.

The present invention lends itself to both military and civilian use. This boat hull design is amenable to jet propulsion power to provide extraordinary speed and stability in shallow water as well as deep, rough water operations. Conventional inboard or outboard motor power would also be applicable to the present invention.

DESCRIPTION OF THE DRAWINGS

In the drawings which form a part of this specification, an improved boat hull constructed in accordance with one of the preferred embodiments of the invention is shown out of the water.

DESCRIPTION OF THE PREFERRED EMBODIMENT

Figure 1:
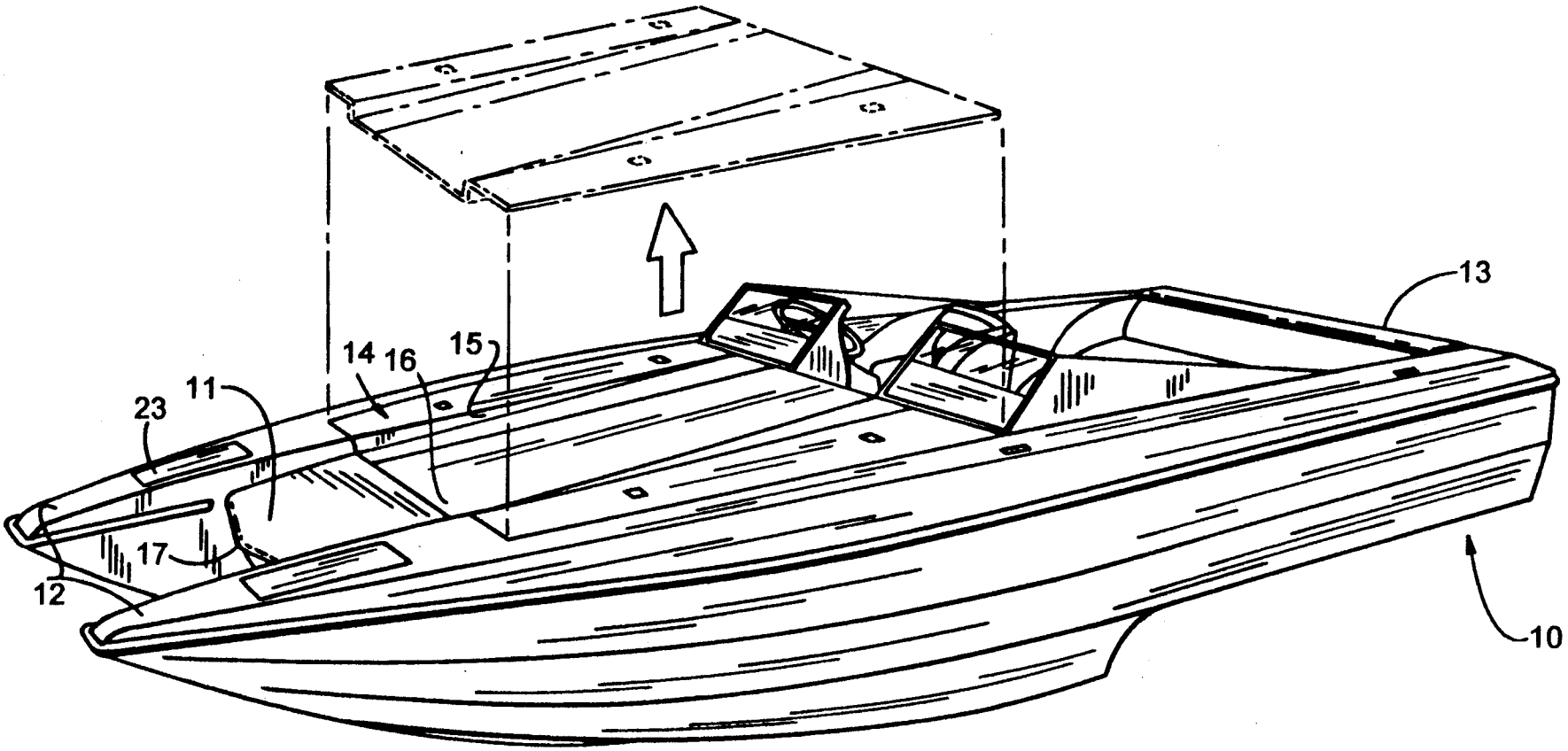
FIG. 1 is a perspective view of the improved boat hull of such embodiment.

The invention will be explained in detail by means of reference to the preferred embodiment shown in the drawings. This embodiment is believed to represent the best mode of the invention at the time of this application. Some specific alterations are anticipated with larger hulls—30 to 80 feet, etc. Explanation of this embodiment assumes that the boat is oriented in its customary position of use.

Figure 4:
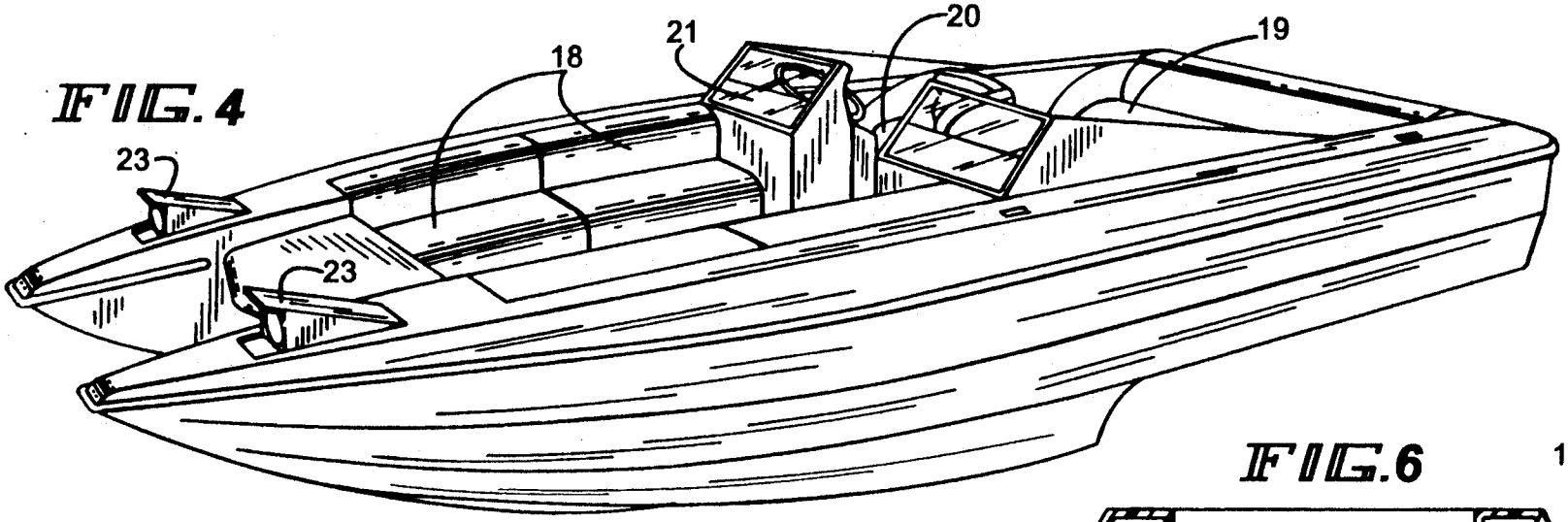
FIG. 4 is an alternate perspective view of the boat hull shown in FIG. 1.

Referring now to FIGS. 1 and 4, there is shown a boat hull 10 comprising generally a central hull portion 11 and like side portions 12. A transom 13 forms the rear portion of the boat hull 10.

As shown in FIG. 1, a removable central deck portion 14 having side fairings 15 and a recessed central fairing 16 provide a cover to the interior portion of a bow 17.

As shown in FIG. 4, with the central deck portion 14 removed, additional seats 18 may be provided to the seats 19 formed in the interior of the rear portion of the boat hull 10. A passageway 20 is formed between a control console 21 and a side console 22 formed directly across the passageway 20 from the control console 21. Retractable headlights 23, shown here in the elevated position, are located on each of the side portions 12.

Figure 2:
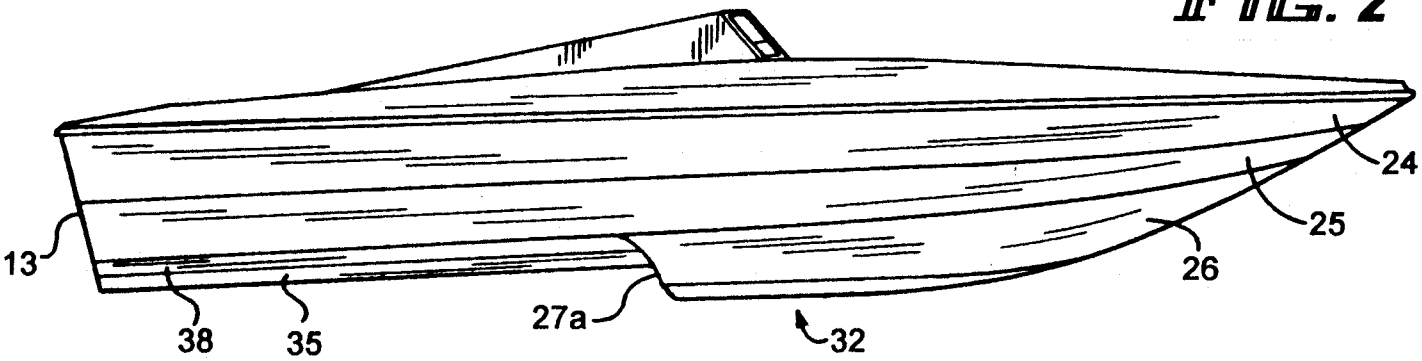
FIG. 2 is a side elevation view of the boat hull of such embodiment.

Referring now to FIG. 2, there are shown an upper panel 24, a middle panel 25 and a lower panel 26 which comprise the outer side walls of the side portions 12.

Figure 3:
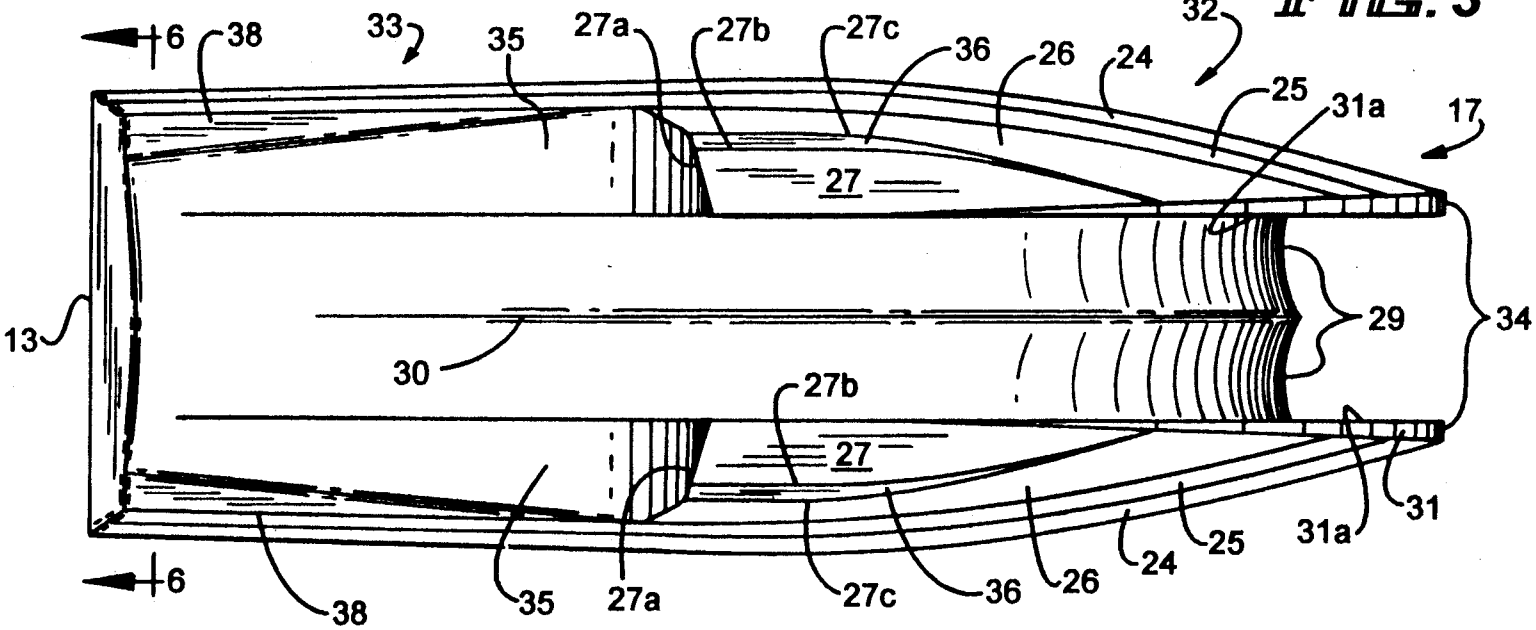
FIG. 3 is a bottom plan view of the boat hull shown in FIG. 1.

Referring to FIG. 3, the central hull portion 11 extends from the transom 13 to a forward point 28. The forward portion of the central hull 11 comprises two (2) concave sides designated as central hull surfaces 29 which are joined at keel 30. A pair of forward sponsons 27 having steps 27*a* are positioned adjacent to the central hull surfaces 29 on each side. The steps 27*a* are located approximately midships and are disposed at greater depth than the central hull 11. The central hull surfaces 29 extend outwardly and upwardly toward an inside surfaces 31*a* of a pair of side floats 31 which, together with upper panel 24, middle panel 25 and lower panel 26, comprise the side portions 12.

As previously described in my U.S. Pat. No. 3,996,869, the longitudinal location of the steps 27*a* is desirably approximately midships. In the case of multiple steps, the forwardmost step is located about midships. The depth of the keel 30 of the central hull 11 at the point at which the floats 31 are stepped may be defined as follows: the angle between the keel line extending forwardly from the transom 13 and the imaginary plane formed by lines extending forwardly from the keel line 30 at the transom 13 to the lowermost points on the floats 31 at the steps 27*a* should be between 1.5° to 2°. The greatest variable in this determination is thus the location of the steps 27*a*. With the step location at approximately the center of gravity of the boat with natural loading, as in the preferred embodiment, this elevational difference is defined by an angle of 1.5° to 2.5° for a sixteen foot hull. That is, the vertical distance between the bottom of the center line 30 and the bottom of the floats at the point where they are stepped is defined by an angle between 1.5° to 2.5°. Regardless of the length of the hull, the angle that defines this elevational distance remains 1.5° to 2.5°.

Each of the side floats 31 is comprised of two (2) portions, a forward portion 32 and a rear portion 33. The forward portion 32 extends from point 34 at the bow 17 to the steps 27*a*. This forward portion 32 is disposed generally at a greater depth than the central hull 11. The rear portion 33 of the side floats 31 extend from the steps 27 aft to the transom 13. The inside surfaces 31*a* of the side floats 31 are substantially vertical, forming tunnel walls that trap hydrodynamic forces beneath the hull providing additional lift. The inside surfaces 31*a* act as stabilizers to prevent the boat hull 10 from sideslipping while turning.

Additionally, the side floats 31 are also comprised of a pair of rear afterplane areas 35 which narrow toward the transom 13.

A pair of forward substantially flat surfaces 36 are formed between a forward inner sponson chine 27*b* and an outer forward sponson chine 27*c*. A pair of rear flat surfaces 38 are formed between side panels 25 and the afterplane area 35. The forward flat surfaces 36 and rear flat surfaces 38 reduce any excessive banking in turns and improve the static, dynamic, lateral and directional stabilities of the boat hull 10. Under power, the forward flat surfaces 36 and rear flat surfaces 38 eliminate spray and the "wet look" when the boat is under power.

The central hull 11 is V-shaped so that the boat will ride with greater stability and buoyancy in rough water, and will support heavier payloads. Generally, the V-shaped hull cuts through rough, choppy waves without pounding uncomfortably hard on the water surface. The knife-like shape of the forward portions of the float 31 also aid in rendering the operation of the boat hull 10 much smoother in rough water, but the real importance of the hull design is in the dihedral tunnel that results from the combination of the central hull 11 and the side floats 31. The desirable effects of incorporating tunnel-type hulls are obtained by this concept, without sacrificing the desirable effects of a V-type hull.

The dihedral tunnel concept results from the combination of the two central hull surfaces 29, which form the top biplanar portion of the tunnel, and the floats' inner surfaces 31*a*, which form the tunnel side walls.

Stepped floats, as provided in this embodiment, are desirably employed to help break suction at planing speed, and do provide improved directional stability since the central hull 11, located between the floats 31, provides cushioning buoyancy so necessary in rough or choppy water. The steps 27*a* constitute a clean break in the planing surface, for the three-fold purpose of reducing wetted surface and hence decreasing skin friction, breaking the suction under the afterbody, and increasing lift by means of the leading edge of the step.

Providing forward flat surfaces 36 and rear flat surfaces 38 enables a boat manufacturer to increase the aspect ratio or the beam-to-length ratio so as to optimize load carrying capability and additional space while providing greater lateral and directional stability. Providing one or more pairs of flat surfaces as described herein is one of the critical aspects of this invention, as the flat surfaces will enable the boat manufacturer to achieve maximum performance with an aspect ratio approaching 1-to-2 or greater.

As seen in FIGS. 2 and 3, the central hull 11 is not coextensive with the side portions 12, although this preferred embodiment should not be considered a limitation as to the relative disposition of the central hull 11 and side portions 12.

Figure 5:
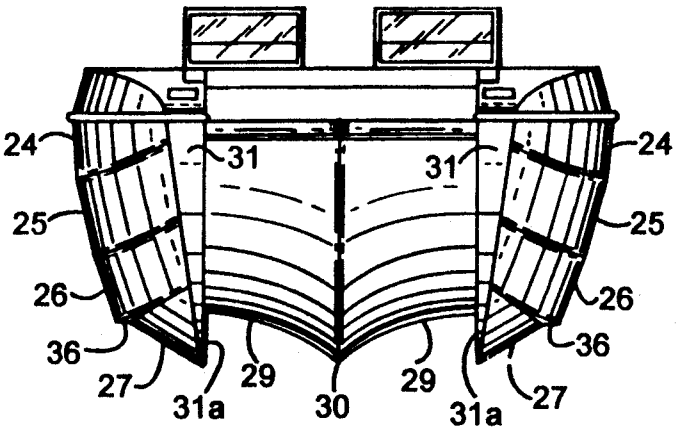
FIG. 5 is a front view of the boat hull shown in FIG. 1.

Turning to FIG. 5, the draft of the keel line 30 is shallower relative to the draft of the side floats 31. The forward flat surfaces 36 act to substantially increase the maneuverability of the boat hull under power through rough water.

Figure 6:
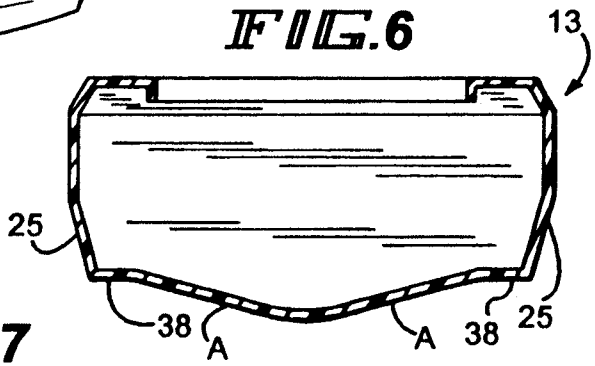
FIG. 6 is a cross-sectional view of the boat hull shown in FIG. 3 across lines 6—6.

FIG. 6 shows an enlarged view of the transom 13 in which the angle formed by the rear afterplane 35 of float 31 extending between the rear flat surface 38 and the keel line 30 is between 12° and 16°, relative to a horizontal plane with the angle for the preferred embodiment shown herein to be approximately 13°. This angle is calculated for a boat such as that shown in the present embodiment having a length of approximately 22 feet.

Figure 7:
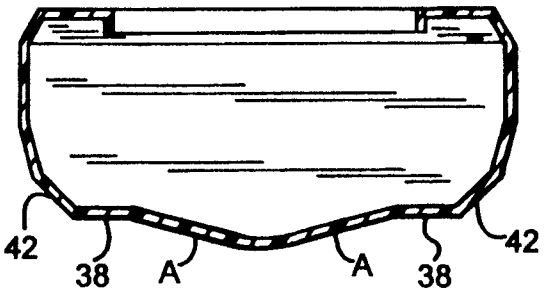
FIG. 7 is a cross-sectinal vew of a 30' boat hull with non-trip chines.

FIG. 7 illustrates the placement of non-trip chines in larger boats. In sizes 30 feet and upward, a pair of non-trip chines 42 are formed at approximately a 45° angle to the planes of the rear surfaces 38 to enhance turning and stability on big waters (heavy seas). The non-trip chines 42 form an additional panel of the sides of the boat hull.

The preferred embodiment is fiberglass molded. While the hull as disclosed and claimed may be constructed of various materials such as wood planks secured to a frame, this explanation of the preferred embodiment assumes that the hull design is a one-piece molded plastic or fiberglass hull. The preferred embodiment of the invention has been illustrated, described and disclosed, but changes and modifications resulting in other embodiments of the hull may be made, and some features of the invention can be used in different combinations without departing from the scope of the invention as defined by the claims set forth herein.

What is claimed is:

1. An improved boat hull designed for stable operation when planing in rough water conditions, said hull having a bow and transom, a forward portion extending longitudinally from said bow to approximately midships, and a rear portion extending longitudinally from approximately midships to said transom, comprising:

a substantially V-shaped central hull portion having a center line area extending from said bow to said transom;

a pair of side portions , one on each side of said central hull portion, said side portions being longitudinally symmetrical, said side portions comprising:

a pair of side floats, one float on each side of said central hull portion, and having inner wall surfaces adjacent the central hull portion;

a pair of outer surfaces, one on each side of said central hull portion, having upper and lower ends, inclined upwardly and outwardly with respect to said central hull portion, and extending over said forward portion;

a pair of afterplane areas, one on each side of said central hull portion, positioned in the rear portion between said center line area and said outer surfaces, and extending over said rear portion;

a pair of substantially flat surfaces located in the rear portion between the outer most ends of the afterplane areas away from said center line area and the lower ends of said pair of outer surfaces, said flat surfaces extending forward from said transom to approximately midships;

said inner wall surfaces adjacent said central hull portion being substantially vertical and defining, in combination with said central hull portion, a dihedral tunnel, and forming, in combination with said outer surface, a bottom edge of said side portions, said bottom edge extending to a depth greater than that of said center line area of said central hull portion, over a substantial length of said forward portion; and a second pair of flat surfaces formed along the forward portion of said boat hull, with one forward flat surface located on each side of said boat hull, said flat surfaces extending longitudinally forward from approximately midships to approximately the middle of the forward portion.

2. A boat hull according to claim 1, wherein an angle is formed by said afterplane between said chine and said center line which extends along said rear portion and is in the range of approximately 12° to 16° relative to the horizontal.

3. A boat hull according to claim 1 wherein maximum performance is achieved with a beam-to-length ratio of at least 1-to-2.

4. A boat hull according to claim 1 wherein a pair of non-trip chines are formed at an angle of approximately 45° to said pair of substantially flat surfaces at the rear portion of said boat.

5. A boat hull according to claim 1 wherein said bottom edge of said side portion extends to a depth greater than said center line area of said central hull portion, wherein said depth is defined by an angle of approximately 1.5°–2.5° which angle is defined by a line extending along said center line area and a line extending from said transom to said bottom edge of said side portion.

* * * * *